US006205621B1

(12) United States Patent
Patelli et al.

(10) Patent No.: US 6,205,621 B1
(45) **Date of Patent: *Mar. 27, 2001**

(54) DEVICE AND METHOD FOR COLLECTING THE WEB, AND DRAWING OF THE LATTER INTO THE FORM OF A STRIP, AT THE OUTPUT OF A CARDER

(75) Inventors: Silvano Patelli; Giovanni Battista Pasini, both of Palazzolo Sull'Oglio (IT)

(73) Assignee: Marzoli S.p.A., Palazzolo Sull'Oglio (IT)

( * ) Notice: Subject to any disclaimer, the term of this patent is extended or adjusted under 35 U.S.C. 154(b) by 0 days.

This patent is subject to a terminal disclaimer.

(21) Appl. No.: 09/418,429

(22) Filed: Oct. 15, 1999

(30) Foreign Application Priority Data

Oct. 20, 1998 (IT) ..... M198A2248

(51) Int. Cl.[7] ..... D01H 5/32
(52) U.S. Cl. ..... 19/240
(58) Field of Search ..... 34/117, 119, 120, 34/122; 100/160, 161, 162 R, 173; 19/106 A, 106 R, 273, 236, 239, 240, 260; 28/110

(56) References Cited

U.S. PATENT DOCUMENTS

| | | | | |
|---|---|---|---|---|
| 4,138,772 | * | 2/1979 | Dilo | 28/110 |
| 4,332,191 | * | 6/1982 | Kankaanpaa | 100/162 R |
| 5,839,165 | * | 11/1998 | Patelli et al. | 19/260 |
| 6,058,571 | * | 5/2000 | Patelli et al. | 19/240 |

FOREIGN PATENT DOCUMENTS

| | | |
|---|---|---|
| 0 775 768 | 5/1997 | (EP) . |
| 0 950 734 | 10/1999 | (EP) . |
| 2 095 059 | 2/1972 | (FR) . |
| WO 98/32903 | 7/1998 | (WO) . |

* cited by examiner

*Primary Examiner*—Stephen Gravini
(74) *Attorney, Agent, or Firm*—Oblon, Spivak, McClelland, Maier & Neustadt, P.C.

(57) ABSTRACT

Method and device for collection of the web at the output of a carder, and concentration of the web into a strip, in which the drawing is carried out simultaneously with the concentration of the web into a strip, between the compactor unit for the web and the pair of calenders of the discharge unit.

13 Claims, 3 Drawing Sheets

DEVICE AND METHOD FOR COLLECTING THE WEB, AND DRAWING OF THE LATTER INTO THE FORM OF A STRIP, AT THE OUTPUT OF A CARDER

The present invention relates to machines for carding of textile fibers, in which the flock fibers are worked in order to produce a web of fibers. In this operation, the short fibers and tangles are removed from the fibers, which are stretched and placed in parallel in a web of fibers, which is disposed on the covering of the drum of the carder, from which the web of fibers is collected by a rotary detachment cylinder with a suitable covering, which is commonly known as a doffer, and is then transferred by another doffer to a compactor unit and to a drawing unit, in order to produce a strip of fibers.

More particularly, the present invention relates to the method and the device in which the web which is detached from the carder is transformed into a strip, and is subjected to controlled drawing, in order to obtain a constant, predetermined yarn count.

In order to make more apparent the technical aspects involved in the carding, reference is made to a diagram of a collection and drawing unit according to the known art, which is described in European patent application no. 775, 768 in the name of the same applicant, illustrated in FIGS. 1 and 2, which show respectively a schematic lateral view and a plan view of the collection and drawing unit.

The detachment cylinder, or doffer, of the carder, is indicated as 1, and on the latter the web 2 of fibers is carried to the unloading cylinder 3, and is conveyed to the compactor unit 4, which consists of a pair of smooth rotary cylinders 5,6, with a substantially horizontal axis, which compact the web 2, which still has a transverse dimension which corresponds to that of the carder, and transfer the web to the subsequent belt conveyor. The compactor unit 4 works at a speed which is compatible with that of the web 2 which is obtained from the unloader 3.

The belt conveyor 10 is in a position which is integral with the collection unit of the web 2, and consists of a pair of belts 11 in a loop, which are opposite, and are guided by means of rollers 12 which have a substantially vertical axis, rotate on pins 13, and are provided with rotary drive 14, by means of their own motor, or by motion derived from other units, in a known manner. The said belts 11 extend along the entire front of the collection unit, as far as lateral return rollers which are not shown in the figure for the sake of simplicity, and leave a central gap 15. The belts are actuated such as to be moved, in the area which is provided for the web of fibers obtained from the compactor unit 4, from the sides towards the center, in order to concentrate and convey the web 2 of fibers into a strip 16, which has a width which corresponds to the gap 15 between the two belts 11. The stretched web 2, which has been condensed into the form of a strip 16, is then yielded to the drawing unit 20, and the linear speed of transfer of the fibrous body is substantially maintained from the compactor unit 4 to the drawing unit 20.

The equipment of the drawing unit 20 is mounted on a mobile carriage, which can move longitudinally, towards and away from the preceding collection unit. This movement is obtained, for example, by placing the equipment of the drawing unit on a transverse frame 21, which slides forwards and rearwards according to the arrow 22 on guides, and is piloted by a double-effect hydraulic cylinder, which is not shown in the figure for the sake of simplicity.

The drawing unit comprises a body in the shape of a funnel 30, which receives the fibers conveyed by the belts 11 in order to form the strip 16, and admits and guides them to the two pairs of cylinders downstream, which carry out the drawing of the strip 16. Of these pairs of cylinders, a first pair of cylinders or rollers 31 and 32 with a horizontal axis comprises the upper roller 31, which is smooth and idle, and is pressed against the roller 32 beneath by means of an adjustable thruster 33 on its shaft 34. The roller 32 is embossed in a transverse direction, and is rotated with a specific drive ratio in a known manner, for example with a pulley and belt drive system, by means of the motor 35. According to the known art, and in general, the first pair of rollers 31,32 works at a linear speed which is slightly greater than that of the strip which is released by the belt conveyor 10, via the funnel 30.

The second pair of cylinders or drawing rollers comprises the roller 38, which is also smooth and idle, and is pressed against the roller 39 beneath, similarly to the first pair of cylinders. The roller 39 is also worked on its surface, and is actuated such that it is driven at a linear speed which is substantially greater than that of the roller 32, according to a ratio which is adjustable, and greater than 1, which gives rise to the drawing, i.e. to the elongation of the strip, which is conveyed between the two pairs of rollers. In other words, the second pair of cylinders 38,39 is actuated such as to be driven at a specific linear speed, which is greater than that of the first pair of cylinders 31,32. Owing to the effect of the linear speed difference between the rollers upstream which release the body of fibers, and the rollers downstream which draw this body towards them, the fibers which are drawn downstream slide relative to the fibers which are retained upstream, and give rise to elongation and drafting of the said body of fibers. The drawing values express ratios between the linear speeds of the fibrous body input, and the fibrous body output.

For this purpose, the two pairs of drawing rollers 31,32 and 38,39 are actuated in a known manner, for example by means of the same motor 35, which is provided with a drive with belts and pulleys of a different diameter, and maintain a pre-determined, constant ratio between the linear speeds at which the strip which is gripped between the two pairs of rollers is yielded by the first pair 31,32, and drawn by the second pair 38,39. In general, the drawing values which are established between the two pairs of rollers are between 1.0 and 2.0, whereas the values which are currently used are within the narrower interval between 1.1 and 1.5.

The strip which is thus produced and drawn is then sent to be collected in a container, for further processing. The distance between the drawing unit and the collection unit is regulated in accordance with the speed at which the carder is actuated, and with the linear speed of collection of the web, as well as in accordance with the characteristics of the fibers worked.

The structural system described hitherto is complex, and requires careful co-ordination of the various members of the collection and drawing units. During the step of collection of the web and drawing of the strip of fibers according to the known art, some problems also arise as a result of the ever-increasing trend towards increasing the speeds, in order to obtain high production volumes. The web must be collected and drawn at a rate of 250–400 m of strip per minute, and this value is destined to increase further, according to the expectations of the textile industry. High speeds of work create problems, in particular in the steps of re-starting, or in general in a transitional stage, in which the sections of web and strip between one point of collection and control and the other can be loose or slack, and can also be disposed in a highly accentuated catenary position. This occurrence is problematic because the consistency of the web and the strip is substantially reduced, since they consist of fibers in parallel. In these loose sections the web and the strip can lose continuity, owing to their own weight, and because of lack of continuity of the drawing to which they are subjected, and this can cause stoppage of production. The technical problem which is derived from these requirements of high carding productivity consists of control and recovery in good time of the loose sections of the web and strip, such that the latter are kept satisfactorily taut even in the transitional and starting steps.

The object of the present invention is to provide a method for collection of the web and drawing of the strip produced by a carder, with control of satisfactory tautness and tensioning of these bodies of fibers, and in a device which has a structure which is simpler to produce and manage.

The present invention consists of a device and a method for collection of the web produced by a carder, and for drawing of the latter into the form of a strip. The salient characteristics of the device for collection and drawing are described in claim 1, and the preferred embodiments are described in the claims which are dependent on the latter; the salient characteristics of: the method are described in claim 5, and the preferred embodiments are described in the claims which are dependent on the latter.

The invention is described hereinafter with reference to a typical embodiment illustrated in FIG. 3, by way of non-limiting example, in order to make more apparent the characteristics and advantages of the present invention, with reference to the attached schematic drawings, in which.

Figure 1:
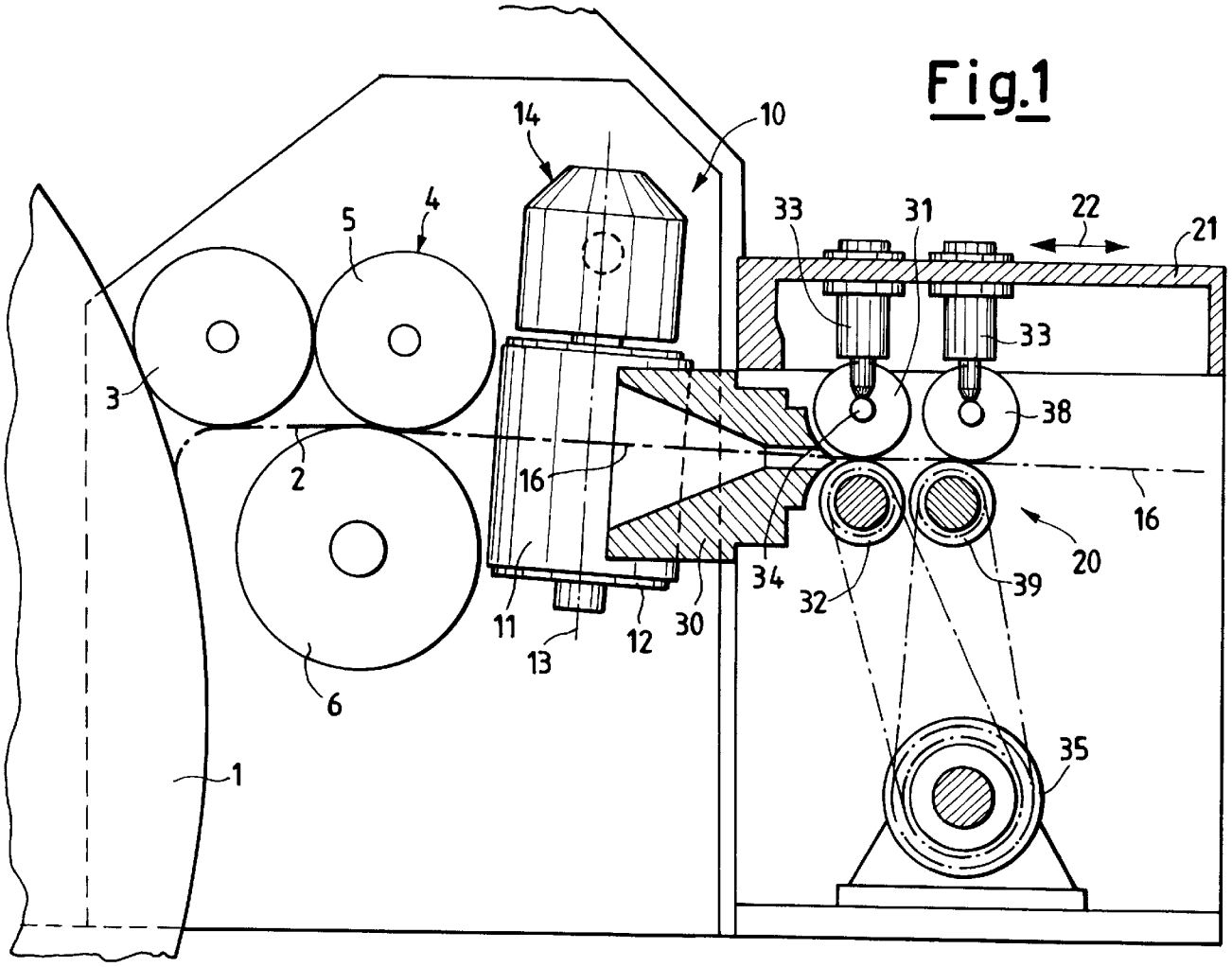
FIGS. 1 and 2 illustrate the technical problem in general.
Figure 2:
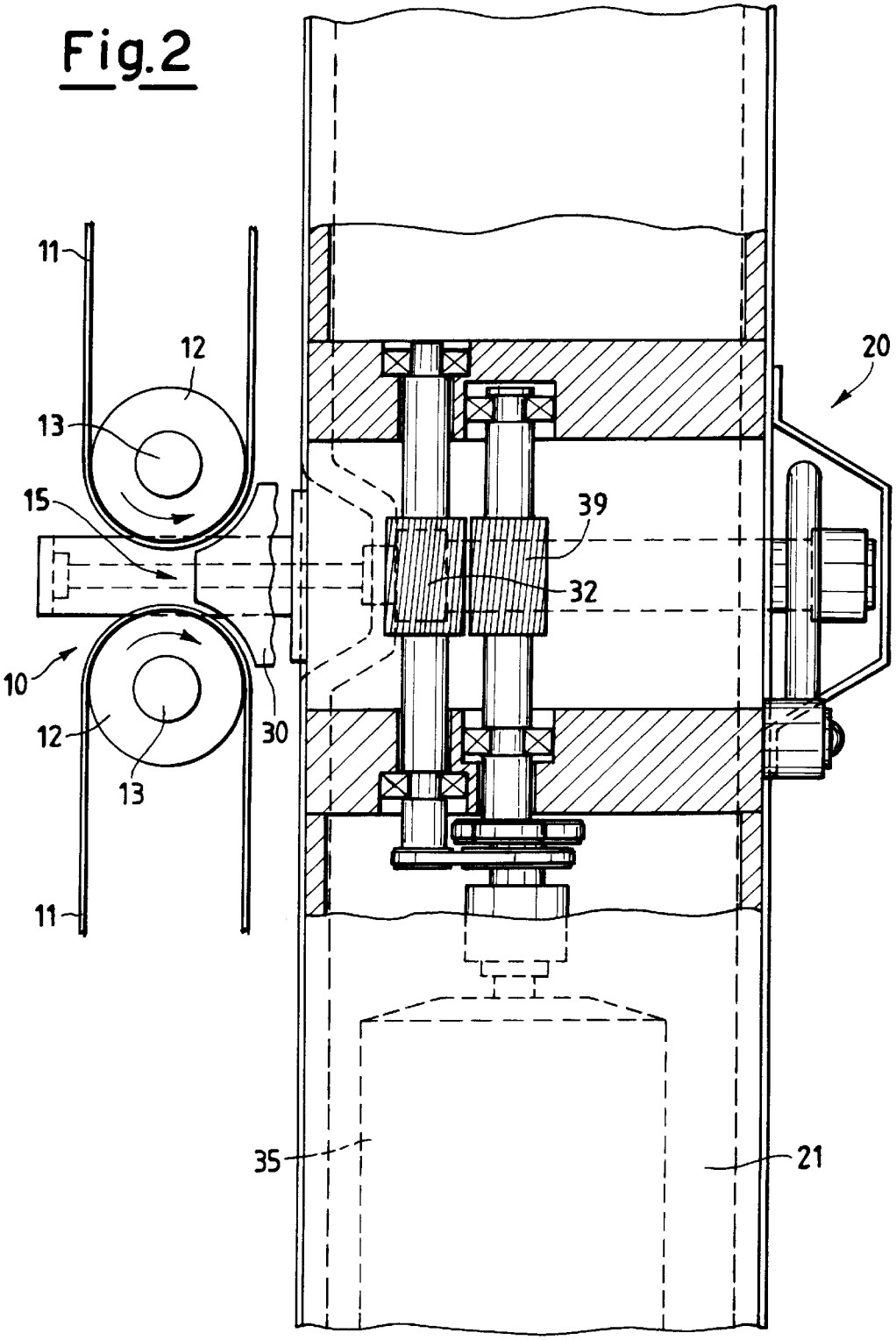
Figure 3:
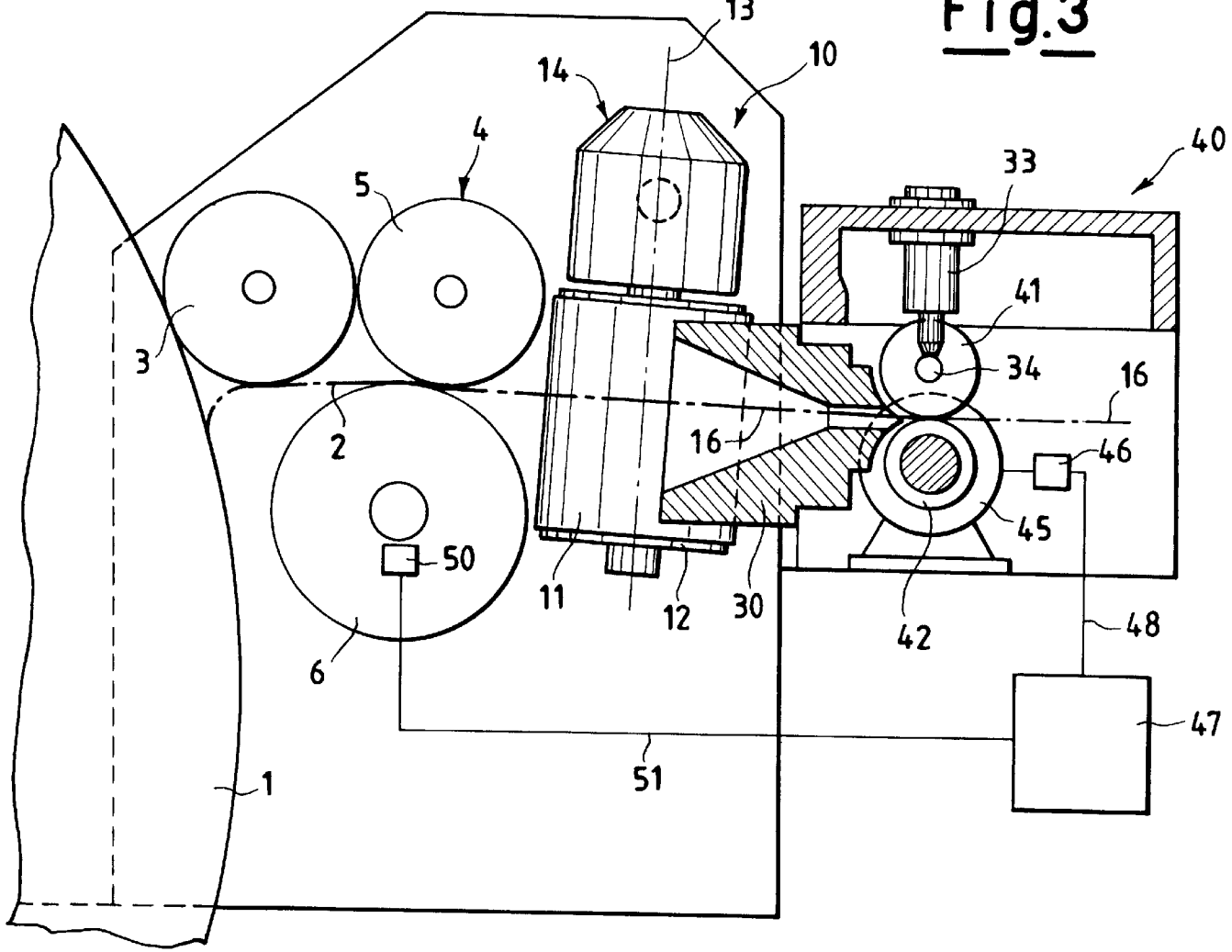
FIG. 3 shows a diagram of the unit according to the invention, for collection of the web, and drawing of the latter into a strip.

FIG. 3 shows an embodiment of the invention in which the drawing operation is carried out simultaneously with transformation into a strip, and not in a subsequent, separate step. The compactor unit 4 is still actuated at the linear speed at which the web 2 is yielded by the doffer 3, but the drawing unit is replaced by a discharge unit 40, which is reduced to a single pair of unloading cylinders or calenders 41,42, of which one is driven and one is an idle, contact type, similar to those described with reference to FIGS. 1 and 2 for the rollers of the drawing unit 20, which engages the strip 16 at the output of the funnel-shaped body 30, and is actuated at a controlled linear speed, which is substantially higher than that of yielding of the web by the compactor unit 4, with a drawing value between the two of between 1.4 and 2.2 at operating speed, and preferably between 1.6 and 2.0.

According to the invention, the pair of calenders 41,42 is actuated by means of an A.C. electric motor 45, which is actuated at a variable speed, and supplied with a variable frequency by means of an inverter 46, which is piloted by the control unit 47 of the carder, via the connections 48. In turn, the compactor unit 4 is actuated by means of an A.C. electric motor, which is supplied with frequency, or is rotated by the doffer 1 or by other units of the carder, such as to impart a pre-determined, constant linear speed to the web 2 which is yielded in the downstream direction. This speed is monitored and transmitted to the control unit 47 of the machine, for example by means of the signal which is conveyed to the latter by a sensor 50 which is disposed on this unit 4, and is connected to the line 51. On the basis of this signal and the geometric characteristics of the rollers of the compactor unit 4 and of the unloading calenders 41,42, the control unit 47 in turn pilots the inverter 46, such as to actuate the frequency of the motor 45, in order for the said calenders to return the strip at the linear speed which corresponds to the required drawing, in the section between the compactor unit 4 and the calenders themselves.

In other words, the task of retaining the fibers upstream in a strip in the drawing unit 20, which according to the known art is carried out by the first pair of drawing rollers 31, 32, is carried out according to the present invention by the compactor unit 4 for the web, in order, simultaneously, to convey the web into the strip 16, and draw it between this compactor unit 4 and the pair of calenders 41,42 for unloading of the strip.

Similarly, if the compactor unit 4 is also actuated by means of an A.C. electric motor with an inverter, in order to pilot the frequency of the unit, this inverter is then also connected to, and controlled by the control unit 47, for the necessary co-ordination of the linear speeds in the compactor unit and in the drawing unit.

Also, in the embodiment described hitherto according to the invention, the arrangement of the discharge unit is advantageous, and substantially consists of the pair of calenders and of the funnelshaped body 30, on a mobile frame 21, which can move in a longitudinal direction. This arrangement makes it possible to regulate the distance which exists between the belt conveyor 10 and the calenders, which corresponds to a section of strip in which the collection into a strip and drawing take place.

In the method for collection of the web 2 and drawing of the strip 16 according to the present invention, the drawing operation is thus carried out simultaneously with concentration into a strip with a drawing value of between 1.4 and 2.2 at operating speeds, and preferably of between 1.6 and 2.0.

An important factor consists of the reliability of the operations in the transitional steps or during starting of the carder, in which the web 2 or the strip 16 may not be subjected to excessive stresses, and may not be discontinuous. In such cases the carder must be stopped, and the operator must recommence from the beginning of the starting procedure, with a consequent loss of time and material.

In a preferred embodiment of the method according to the present invention, in the transitional steps, and in particular in the step of starting the machine, operation at the outset takes place with low drawing values, with low drawing values of between 1.0 and 1.3, and preferably of approximately 1.1. In this step, the strip is inserted in the drawing unit, and the distance between the collection unit and the drawing unit is modulated. During starting or re-starting, the operator must take the web from between the belts and insert it into the drawing unit, and in this step it is probable that the web will slacken between the various units. When operation has started, the drawing value is then progressively increased to the operating values, which are between 1.4 and 2.2, and preferably between 1.6 and 2.0. This increment in the drawing values can be applied in steps or continuously. This progressive increase in speed permits more reliable starting, and control and recovery of the loose sections. During the starting or transitional steps, the compactor unit 4 can already be actuated at the operating speed.

Similarly to in the starting step, the device according to the invention makes it possible to actuate modulation of the speeds of the compactor unit 4 and of the pair of calenders 41,42, as well as of their ratio in the steps of slowing down or stoppage of the carder, such as to ensure that the content of the fibers in the machine is always discharged in a strip according to the specifications, and without any clogging, even when the supply upstream is modified.

The method and the device according to the present invention constitute significant progress in relation to the known art, and at least the following aspects merit explicit consideration.

The operation of drawing simultaneously with concentration of the web into a strip, which thus reduces drastically the drawing unit, simplifies the machine greatly and makes it possible to carry out the drawing more gradually and regularly in the section which is controlled both by the belt conveyor 10 and by the funnel 30, for the same characteristics of the fibers which are being worked, and for the same CVt of the strip.

The method for starting with modulation of the value of the drawing between the compactor unit 4 and the unloading calenders 41,42 makes it possible to start the machine with a web which is more consistent, and to recover in good time any slack, as well as to prevent breakages of the web or strip, and to avoid repetition of the starting operations. This starting method leads to consistent saving of time and material, and provides an improved factor of service of the machine.

What is claimed is:

1. A device for collecting and drawing a web of fibers from a carder having, in sequence, a doffer, an unloading cylinder, a compactor unit, and a belt conveyor, said carder being configured to concentrate the web of fibers into a strip having a width which corresponds to a width of a gap through which the strip is passed to a discharge unit wherein the discharge unit comprises:

a pair of unloading calenders driven by a drive unit so that the unloading calenders draw the strip at a linear speed which is greater than a linear speed of the strip at an output of the compactor unit; and a control unit configured to control the linear speed of the drawing of the strip by the pair of unloading calenders relative to the linear speed of the strip at an output of the compactor unit in order to simultaneously carry out concentration of the web of fibers into the strip and the drawing of the strip between the pair of unloading calenders.

2. The device according to claim 1, wherein the drive unit includes an A.C. electric motor receiving a speed control signal from an inverter controlled by the control unit, the A.C. electric motor being connected to drive the pair of unloading calenders to draw the strip at said linear speed.

3. The device according to claim 2, wherein a speed measurement sensor is configured to detect a compactor unit speed indicative of the linear speed imparted to the strip at the output of the compactor unit and is connected to the control unit to input the detected compactor unit speed to the control unit to control the inverter to have an output frequency related to the compactor unit speed as said speed control signal.

4. The device according to claim 1, wherein the discharge unit is disposed on a mobile frame configured to move longitudinally.

5. A method for collecting and drawing a web of fibers from an output unit of a carder, comprising a sequential series of steps of:

taking the web of fibers from a doffer using an unloading cylinder;

conveying the web of fibers taken from the doffer to a compactor unit;

passing the web of fibers from the compactor unit to a belt conveyor;

passing the web of fibers from the belt conveyor through a gap to concentrate the web of fibers into a strip; and transferring the strip from the gap to a discharge unit, wherein the transferring step is carried out simultaneously with the concentration of the web into the strip and includes drawing the strip between a pair of calenders in the discharge unit at a linear speed related to the speed at which the compactor unit passes the web of fibers to the belt conveyor.

6. The method according to claim 5, wherein the drawing is carried out under normal operating conditions at a ratio between the linear speed and the speed at which the compactor unit passes the web of fibers to the belt conveyor having a normal drawing value which is between 1.4 and 2.2.

7. The method according to claim 6, wherein the drawing is carried out at an initial drawing value of the ratio between 1.0 and 1.3 during startup and transitions and then the initial drawing value is progressively taken to the normal drawing value.

8. The method according to claim 6, wherein the initial drawing value is progressively taken to the normal drawing value in incremental steps.

9. The method according to claim 5, wherein the drawing is carried out under normal operating conditions at a ratio between the linear speed and the speed at which the compactor unit passes the web of fibers to the belt conveyor having a normal drawing value which is between 1.6 and 2.0.

10. The method according to claim 6, wherein the drawing is carried out at an initial drawing value of the ratio at approximately 1.1 during startup and transitions and then the initial drawing value is progressively taken to the normal drawing value.

11. The method according to claim 10, wherein the initial drawing value is progressively taken to the normal drawing value in incremental steps.

12. The method according to claim 9, wherein the drawing is carried out at an initial drawing value of the ratio at approximately 1.1 during startup and transitions and then the initial drawing value is progressively taken to the normal drawing value.

13. The method according to claim 12, wherein the initial drawing value is progressively taken to the normal drawing value in incremental steps.

* * * * *

UNITED STATES PATENT AND TRADEMARK OFFICE

CERTIFICATE OF CORRECTION

PATENT NO. : 6,205,621 B1
DATED : March 27, 2001
INVENTOR(S) : Patelli et al.

It is certified that error appears in the above-identified patent and that said Letters Patent is hereby corrected as shown below:

Title page,
Item (30), the Foreign Application Priority information is incorrect. Item (30) should read as follows:

(30) Foreign Application Priority Data

Oct. 20, 1998 (IT).....MI98A2248

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*